US006506047B1

(12) United States Patent
Aleardi et al.

(10) Patent No.: US 6,506,047 B1
(45) Date of Patent: Jan. 14, 2003

(54) FAST-FIT ELECTRONIC GAS-LIGHTING DEVICE

(75) Inventors: Massimo Aleardi, Cassano Magnago (IT); Raoul Bianchi, Villa Guardia (IT)

(73) Assignee: ITW Industrial Components S.r.l., Milan (IT)

( * ) Notice: Subject to any disclaimer, the term of this patent is extended or adjusted under 35 U.S.C. 154(b) by 0 days.

(21) Appl. No.: 09/744,545

(22) PCT Filed: Jul. 28, 1999

(86) PCT No.: PCT/IT99/00245

§ 371 (c)(1),
(2), (4) Date: Mar. 27, 2001

(87) PCT Pub. No.: WO00/06951

PCT Pub. Date: Feb. 10, 2000

(30) Foreign Application Priority Data

Jul. 28, 1998 (IT) ..... TO98A0651

(51) Int. Cl.[7] ..... F23Q 3/00

(52) U.S. Cl. ..... 431/258; 431/114; 126/39 BA; 361/253

(58) Field of Search ..... 431/258, 263, 431/264, 114, 255, 254; 126/39 BA, 39 E; 361/263, 253, 600

(56) References Cited

U.S. PATENT DOCUMENTS 4,683,518 A 7/1987 Gwozdz ..... 431/264

FOREIGN PATENT DOCUMENTS

EP 0 819 890 A 1/1998

OTHER PUBLICATIONS

Patent Abstracts of Japan; Shimamoto Toshiaki; "Discharge Ignition Device of Gas Appliance"; Publication No. 60142117, Publication Date: Jul. 27, 1985 and Application No. 58250921, Application Date: Dec. 28, 1983.

Patent Abstracts of Japan; Nakagawa Toshihiko; "Case of Ingitor"; Publication No. 08097058, Publication Date: Apr. 12, 1996 and Application No. 06234694, Application Date: Sep. 29, 1994.

*Primary Examiner*—Henry Bennett
*Assistant Examiner*—Josiah C. Cocks
(74) *Attorney, Agent, or Firm*—Lowe Hauptman Gilman & Berner, LLP

(57) ABSTRACT

An electronic gas-lighting device (1) having a casing (2) made of insulating material and defined by a cup-shaped body (6); electronic high-voltage-pulse generating means (3) housed in an inner cavity (7) of the casing (2) and including noise suppressing means (4) in turn including a ground connection (26); and assembly means (5) for removably fitting the casing (2) to a supporting surface of a metal conducting body element of an electric household appliance, in particular, a cooking range with gas burners. The ground connection (26) is defined by an elastically deformable conducting element (27) which is connected electrically to the noise suppressing means (4), projects outside the cavity (7) on the same side as the assembly means (5), and is so formed as to be interposed, in use, between the casing (2) and the supporting surface and gripping between the casing (2) and the metal conducting body element by means of the assembly means (5).

22 Claims, 1 Drawing Sheet

FAST-FIT ELECTRONIC GAS-LIGHTING DEVICE

TECHNICAL FIELD

The present invention relates to an electronic gas-lighting device having electromagnetic-noise suppressing means and which can be fitted extremely quickly and efficiently to a metal conducting body element of an electric household appliance, in particular a cooking range of a gas cooker.

BACKGROUND ART

Cooking ranges are known featuring integrated electric/electronic gas-lighters which are operated manually by means of pushbuttons to generate a spark by which to light one of the gas burners on the range. Known gas-lighters comprise a current-discharge generating circuit connected to one or more output terminals, each of which is connected by a conducting wire to an electrode located close to a burner to be lit: the electrodes are grounded by the range to which they are fitted. A spark is therefore generated between each electrode and each burner whenever a current discharge is generated in the circuit.

The current-discharge generating circuit may be conformed differently, but normally always poses the problem of also generating, during discharge, electromagnetic noise which may interfere with more delicate electronic equipment, such as radios, televisions, etc. For this reason, international standards provide for fitting the discharge generating circuit—or, more generally speaking, the gas-lighting device—with noise suppressing means which normally comprise an electronic filter fitted upstream from the generating circuit, towards the electricity mains. Most known noise suppressing means need grounding and, in known lighting devices, the ground connection—which is only called upon to withstand low currents (less than 1 and usually of about 0.1 ampere)—is made by means of a wire fitted to a terminal board supplying the range, or to a contact in turn fitted to the range, which is grounded by the terminal board. The wire must be connected to the noise suppressing means, which is done using removable connectors, such as Faston contacts, or by soldering. Whichever the case, grounding the noise suppressing means involves considerable cost, greatly increases the time taken to assemble the range, and prevents the range from being assembled automatically. What is more, the terminals to which the high-voltage current discharges are sent may interact with the metal of which the range is made and generate parasitic discharges which are dispersed to ground, thus impairing operation of the gas-lighting device.

DISCLOSURE OF INVENTION

It is an object of the present invention to provide an electronic gas-lighting device designed to eliminate the aforementioned drawbacks, and which, is particular, provides for straightforward, fast, low-cost grounding of the noise suppressing means by means of straightforward movements permitting automatic assembly of the gas-lighting device as a whole.

According to the present invention, there is provided an electronic gas-lighting device comprising a casing made of insulating material and defined by a cup-shaped body; electronic high-voltage-pulse generating means and electromagnetic-noise suppressing means, both housed in an inner cavity of the casing; a ground connection for said noise suppressing means; and assembly means for removably fitting said casing to a supporting surface of a metal conducting body element of an electric household appliance, in particular, a cooking range with gas burners for which said gas-lighting device is designed; characterized in that the ground connection is defined by an elastically deformable conducting element which is connected electrically to said noise suppressing means, projects outside said cavity on the same side as said assembly means, is positioned facing at least part of an outer surface of the casing, and is so formed as to be interposed, in use, between the casing and said metal conducting body element and gripped between the casing and the metal conducting body element by means of said assembly means.

More specifically, said conducting element defining the ground connection of the noise suppressing means is defined by a substantially U-shaped contact bracket fitted astride an edge—defining a mouth of said cavity—of the cup-shaped body defining the casing; the bracket comprising a first branch located inside the casing and connected electrically and mechanically to the noise suppressing means, and a second branch which is located outside the casing, is positioned facing and at a distance from said outer surface of the casing, and is elastically deformable to vary the distance between itself and said outer surface of the casing.

When fitting the device to the cooking range, which is conductive, the only connection required, therefore, is a normal removable mechanical connection of the nonconducting body of the gas-lighting device to the cooking range by means of said assembly means. In so doing, in fact, the U-shaped contact bracket is gripped between the casing and the range, and the outer branch of the bracket is deformed elastically, is "pinched" between the range and the outer surface of the casing, and so mechanically and electrically contacts, with a predetermined pressure, the conducting surface of the range to effect the desired ground connection.

The assembly means may be of any type, for example, screws inserted through seats in the casing, or, according to a preferred embodiment, two teeth—at least one of which is elastically deformable—formed in one piece with and projecting laterally from said casing, on the same side as the U-shaped contact bracket, and in particular in a direction substantially perpendicular to a lateral face of the casing having said edge astride which said U-shaped contact bracket is fitted.

Said lateral face of the casing is also provided externally with at least two pins or projections projecting with respect to said outer surface of the casing and for keeping the outer surface of the casing detached, in use, from the conducting surface of the cooking range and so increasing the distance, in use, between the conducting surface and at least one respective terminal—of a circuit defining said electronic pulse generating means—housed through a duct defined by a tubular projection which is formed integrally with the casing and projects perpendicularly from a bottom wall, substantially perpendicular to said lateral face with the pins or projections, of the cup-shaped body defining the casing.

Said U-shaped contact bracket is preferably positioned with the second branch astride one said pin or projection.

BRIEF DESCRIPTION OF DRAWINGS

A non-limiting embodiment of the present invention will be described by way of example with reference to the accompanying drawings, in which.

BEST MODE FOR CARRYING OUT THE INVENTION

Figure 1:
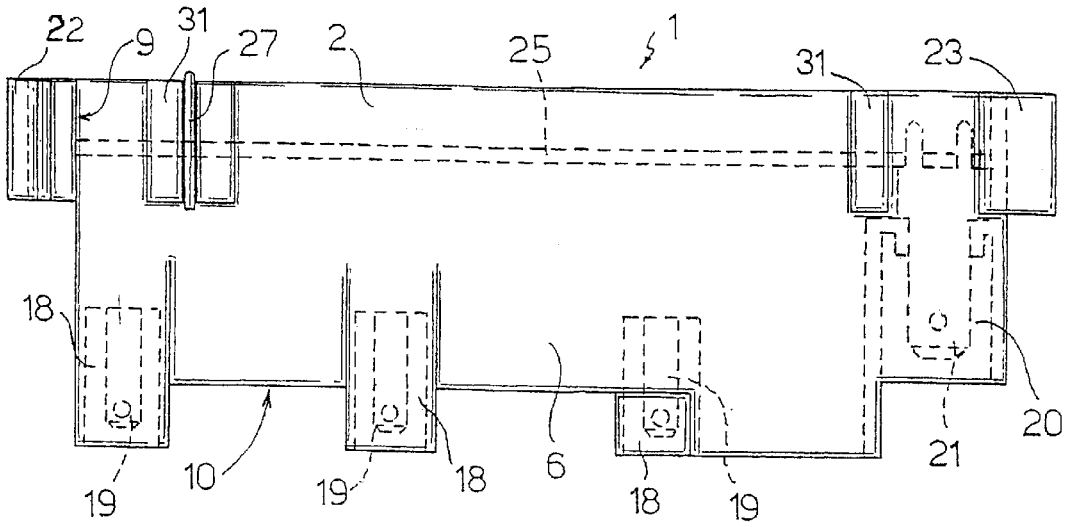
FIG. 1 shows an elevation of a fast-fit gas-lighting device in accordance with the present invention.
Figure 2:
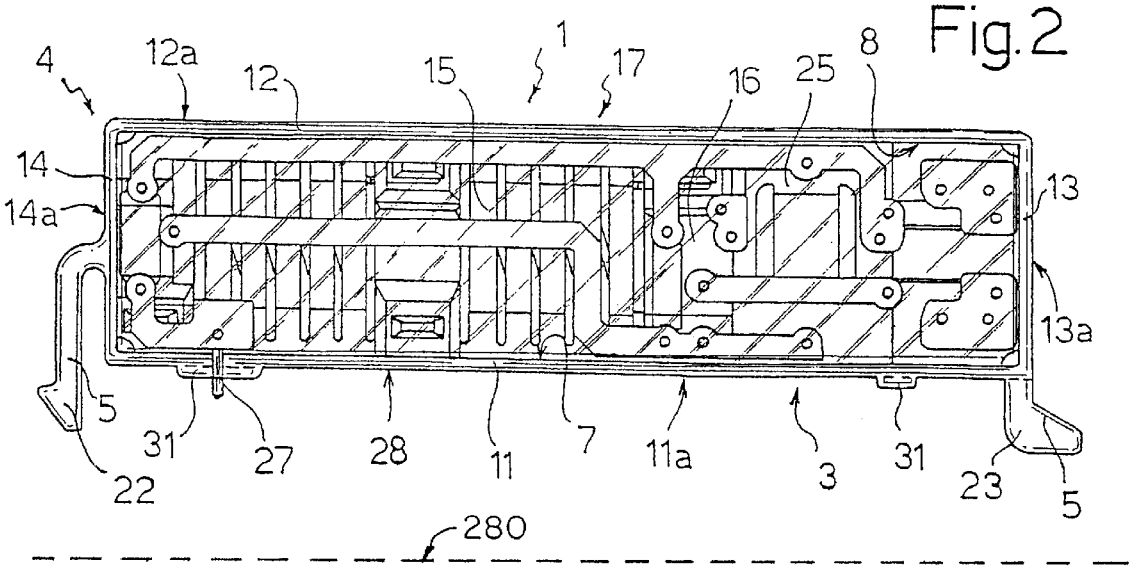
FIG. 2 shows a top plan view of the FIG. 1 device.
Figure 3:
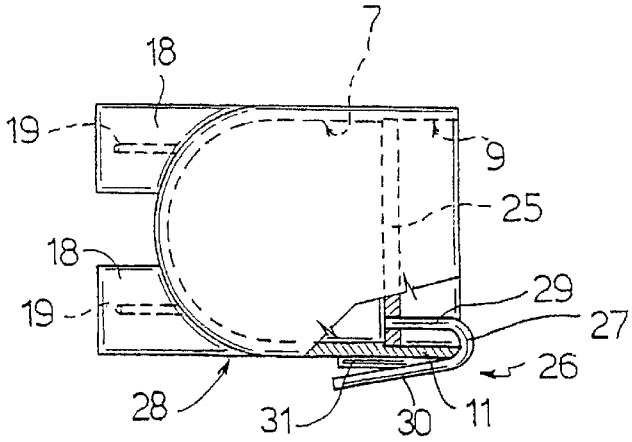
FIG. 3 shows a front-end view of the FIG. 1 and device.

With reference to FIGS. 1 to 3, number 1 indicates as a whole an electronic gas-lighting device fittable to a conducting body element of an electric household appliance, e.g. to a conducting supporting surface (280, illustrated by the dotted line in FIG. 2) of a known cooking range (not shown for the sake of simplicity) with gas burners.

Device 1 comprises a casing 2 made of insulating material; electronic high-voltage-pulse generating means 3 and electromagnetic-noise suppressing means 4, both housed inside casing 2; and assembly means 5 for removably fitting casing 2 to the supporting surface of the cooking range.

Casing 2 of insulating material is defined by a cup-shaped body 6 and has an inner cavity 7 housing high-voltage pulse generating means 3 and noise suppressing means 4; and an edge 8 of cup-shaped body 6 defines a mouth 9 of cavity 7. In the non-limiting example shown in FIGS. 1 to 3, body 6 comprises a substantially rectangular bottom wall 10 opposite and facing mouth 9; and four lateral walls 11, 12, 13, 14 project perpendicularly from bottom wall 10, define respective outer lateral faces 11*a*, 12*a*, 13*a*, 14*a* of casing 2, and each define a respective portion of edge 8 (which in turn is substantially rectangular).

Electronic high-voltage-pulse generating means 3 are substantially known and comprise in particular a transformer 15, a voltage discharger 16, and any other electric or electronic components (all known and not described in detail for the sake of simplicity) defining as a whole a high-voltage-pulse generating circuit 17 (operating in known manner).

Bottom wall 10 of body 6 defining casing 2 is provided externally with at least one duct 18 projecting perpendicularly and defined by a tubular projection formed integrally with casing 2 and through which is housed at least one respective terminal 19 of electric circuit 17.

More specifically, in the preferred embodiment shown, bottom wall 10 has four parallel ducts 18 for respective terminals 19 connected to opposite ends of two secondary windings of transformer 15; and terminals 19 are all defined by respective metal conducting blades which, in the example shown, are parallel to one another and substantially perpendicular to bottom wall 10. Bottom wall 10 is also provided with a further two ducts 20—also substantially parallel to ducts 18—for respective terminals 21 for connecting circuit 17 to a supply line.

In the non-limiting example shown, assembly means 5 for fitting casing 2 to the cooking range are defined by fitting elements e.g. two teeth 22, 23—at least one of which is elastically deformable—formed integrally with casing 2 and projecting laterally from casing 2 beyond and a direction substantially perpendicular to lateral wall 11. Teeth 22, 23 engage respective retaining seats (not shown) formed in a supporting surface of a metal conducting element of the cooking range for which device 1 is designed, so as to enable removable fitment of casing 2 to the supporting surface. Assembly means 5 or fitting elements may, of course, be other than as described for example, in a variation not shown for the sake of simplicity but obvious to a person skilled in the field, assembly means 5 may be defined by screws inserted through seats in casing 2.

As shown in particular in FIG. 2, high-voltage-pulse generating circuit 17 of device 1 is a printed circuit on a connecting board 25, e.g. a substantially flat, rectangular board, substantially closing mouth 9 of cavity 7 of casing 2 and also supporting electronic high-voltage-pulse generating means 3 and noise suppressing means 4.

Noise suppressing means 4 are also substantially known and comprise, for example, an electronic filter connected to circuit 17. Noise suppressing means 4 comprise a circuit having a ground connection 26.

According to the invention, ground connection 26 is defined by an elastically deformable conducting element 27 connected electrically to noise suppressing means 4 and projecting outside cavity 7 on the same side as teeth 22, 23. Conducting element 27 faces at least part of an outer surface 28 of casing 2—defined, in the example shown, by outer lateral face 11*a* of casing 2 (defined by lateral wall 11 of casing 2)—and is so formed as to be interposed and gripped, in use, between casing 2 and the metal conducting element of the cooking range.

In the preferred embodiment shown in FIGS. 1 to 3, conducting element 27 is defined by a substantially U-shaped contact bracket fitted astride edge 8 of cup-shaped body 6, and more specifically astride the portion of edge 8 defined by lateral wall 11. In particular, contact bracket 27 comprises a first branch 29 housed inside casing 2 and connected electrically and mechanically to noise suppressing means 4; and a second branch 30 located outside casing 2 and positioned facing and a predetermined distance from outer surface 28 of lateral wall 11 of casing 2. Second branch 30 of contact bracket 27 is so formed as to vary the distance between itself and outer surface 28 as a result of elastic deformation of contact bracket 27.

Teeth 22, 23, as stated, project from casing 2 in a direction substantially perpendicular to lateral wall 11, which is fitted with U-shaped contact bracket 27 astride the respective portion of edge 8.

Outer surface 28 is also provided, e.g. close to respective longitudinal ends, with at least two pins or projections 31 projecting with respect to outer surface 28 and for keeping outer surface 28 detached, in use, from the conducting supporting surface 280 of the cooking range to which device 1 is fitted, and so increasing the distance, in use, between the supporting surface 280 and terminals 19 of circuit 17 housed through respective ducts 18 projecting perpendicularly from bottom wall 10 of casing 2. In the preferred embodiment shown in FIGS. 1 to 3, U-shaped contact bracket 27 is positioned with second branch 30 astride one of pins or projections 31.

Casing 2 is fitted, by means of assembly means 5, to a conducting supporting surface of a cooking range; in the course of which operation, ground connection 26 is interposed between casing 2 (more specifically, outer lateral face 11*a*) and the cooking range, and U-shaped contact bracket 17 is so deformed elastically that branch 30 is moved towards outer surface 28 of casing 2 and, once the casing is assembled, is gripped between outer surface 28 and the cooking range.

Clearly, changes may be made to the device as described above without, however, departing from the scope of the accompanying claims.

What is claimed is:

1. An electronic gas-lighting device (1), comprising:

a casing (2) made of insulating material and defined by a cup-shaped body (6);

electronic high-voltage-pulse generating means (3) and electromagnetic-noise suppressing means (4), both housed in an inner cavity (7) of the casing (2);

a ground connection (26) for said noise suppressing means (4); and assembly means (5) for removably fitting said casing (2) to a supporting surface (280) of a metal conducting body element of a cooking range with gas burners for which said gas-lighting device (1) is designed;

wherein the ground connection (26) is defined by an elastically deformable conducting element (27) which is connected electrically to said noise suppressing means (4), projects outside said cavity (7) on the same side as said assembly means (5), is positioned facing at least part of an outer surface (28) of the casing (2), and is adapted to be interposed, in use, between the casing (2) and said metal conducting body element and gripped between the casing and the metal conducting body element by means of said assembly means (5).

2. A device as claimed in claim 1, wherein said cavity (7) has a mouth (9) defined by an edge (8), and said conducting element defining the ground connection (26) of the noise suppressing means (4) is defined by a substantially U-shaped contact bracket (27) fitted astride said edge (8).

3. A device as claimed in claim 2, wherein said contact bracket (27) comprises a first branch (29) located inside the casing (2) and connected electrically and mechanically to said noise suppressing means (4), and a second branch (30) located outside the casing (2) and positioned facing and at a distance from said outer surface (28) of the casing (2); said second branch (3) being so formed as to vary the distance between itself and said outer surface (28) of the casing (2) as a result of elastic deformation of said contact bracket (27).

4. A device as claimed in claim 1, wherein said assembly means (5) are defined by screws inserted through seats in the casing (2).

5. A device as claimed in claim 2, wherein said assembly means (5) are defined by two teeth (22, 23), at least one of which is elastically deformable, formed integrally with said casing (2) and projecting laterally from the casing on the same side as the U-shaped contact bracket (27).

6. A device as claimed in claim 5, wherein said cup-shaped body (6) defining said casing (2) comprises a bottom wall (10) opposite and facing said mouth (9), and four lateral walls (11, 12, 13, 14) which are substantially perpendicular to said bottom wall (10), define respective outer lateral faces (11*a*, 12*a*, 13*a*, 14*a*) of said casing (2), and each defines a respective portion of said edge (8) defining said mouth (9); said teeth (22, 23) projecting from said casing (2) in a direction substantially perpendicular to a first (11*a*) of said lateral faces supporting the U-shaped contact bracket (27) astride the respective said portion of said edge (8).

7. A device as claimed in claim 6, wherein said bottom wall (10) of the cup-shaped body (6) defining the casing (2) is provided on the outside with at least one duct (18) projecting perpendicularly and defined by a tubular projection formed integrally with the casing (2); and wherein, in combination, said first lateral face (11*a*) of the casing (2) is provided on the outside with at least two pins or projections (31) projecting with respect to said outer surface (28) of the casing (2) and for keeping the outer surface detached, in use, from the conducting surface of the cooking range, and so increasing the distance, in use, between the conducting surface and at least one respective terminal (19) of a circuit (17) defining said high-voltage-pulse generating means (3), said at least one respective terminal (19) being housed in said duct (18).

8. A device as claimed in claim 7, wherein the U-shaped contact bracket (27) is positioned with the second branch (30) astride one said pin or projection (31).

9. A device as claimed in claim 2, wherein said assembly means (5) are defined by screws inserted through seats in the casing (2).

10. A device as claimed in claim 3, wherein said assembly means (5) are defined by screws inserted through seats in the casing (2).

11. A device as claimed in claim 3, wherein said assembly means (5) are defined by two teeth (22, 23), at least one of which is elastically deformable, formed integrally with said casing (2) and projecting laterally from the casing on the same side as the U-shaped contact bracket (27).

12. An electronic gas-lighting device (1), comprising:

a casing (2) made of insulating material and defined by a cup-shaped body (6);

an electronic high-voltage-pulse generating circuit (17) and an electromagnetic-noise suppressing circuit (4), both housed in an inner cavity (7) of the casing (2);

a ground connection (26) for said noise suppressing circuit (4); and fitting elements (5) for removably fitting said casing (2) to a supporting surface (280) of a metal conducting body element of a cooking range with gas burners for which said gas-lighting device (1) is designed;

wherein the ground connection (26) is defined by an elastically deformable conducting element (27) which is connected electrically to said noise suppressing circuit (4), projects outside said cavity (7) on the same side as said fitting elements (5), is positioned facing at least part of an outer surface (28) of the casing (2), and is adapted to be interposed, in use, between the casing (2) and said metal conducting body element and gripped between the casing and the metal conducting body element by means of said fitting elements (5).

13. A device as claimed in claim 12, wherein said cavity (7) has a mouth (9) defined by an edge (8), and said conducting element defining the ground connection (26) of the noise suppressing circuit (4) is defined by a substantially U-shaped contact bracket (27) fitted astride said edge (8).

14. A device as claimed in claim 13, wherein said contact bracket (27) comprises a first branch (29) located inside the casing (2) and connected electrically and mechanically to said noise suppressing circuit (4), and a second branch (30) located outside the casing (2) and positioned facing and at a distance from said outer surface (28) of the casing (2); said second branch (30) being so formed as to vary the distance between itself and said outer surface (28) of the casing (2) as a result of elastic deformation of said contact bracket (27).

15. A device as claimed in claim 12, wherein said fitting elements comprise screws inserted through seats in the casing (2).

16. A device as claimed in claim 13, wherein said fitting elements comprise two teeth (22, 23), at least one of which is elastically deformable, formed integrally with said casing (2) and projecting laterally from the casing on the same side as the U-shaped contact bracket (27).

17. A device as claimed in claim 16, wherein said cup-shaped body (6) defining said casing (2) comprises a bottom wall (10) opposite and facing said mouth (9), and four lateral walls (11, 12, 13, 14) which are substantially perpendicular to said bottom wall (10), define respective outer lateral faces (11*a*, 12*a*, 13*a*, 14*a*) of said casing (2), and each defines a respective portion of said edge (8) defining said mouth (9); said teeth (22, 23) projecting from said casing (2) in a direction substantially perpendicular to a first (11*a*) of said lateral faces supporting the U-shaped contact bracket (27) astride the respective said portion of said edge (8).

18. A device as claimed in claim 17, wherein said bottom wall (10) of the cup-shaped body (6) defining the casing (2) is provided on the outside with at least one duct (18) projecting perpendicularly and defined by a tubular projection formed integrally with the casing (2); and wherein, in combination, said first lateral face (11*a*) of the casing (2) is provided on the outside with at least two pins or projections (31) projecting with respect to said outer surface (28) of the casing (2) and for keeping the outer surface detached, in use, from the conducting surface of the cooking range, and so increasing the distance, in use, between the conducting surface and at least one respective terminal (19) of a circuit (17) defining said high-voltage-pulse generating circuit (3), said at least one respective terminal (19) being housed in said duct (18).

19. A device as claimed in claim 18, wherein the U-shaped contact bracket (27) is positioned with the second branch (30) astride one said pin or projection (31).

20. A device as claimed in claim 13, wherein said fitting elements comprise screws inserted through seats in the casing (2).

21. A device as claimed in claim 14, wherein said fitting elements comprise screws inserted through seats in the casing (2).

22. A device as claimed in claim 14, wherein said fitting elements comprise two teeth (22, 23), at least one of which is elastically deformable, formed integrally with said casing (2) and projecting laterally from the casing on the same side as the U-shaped contact bracket (27).

* * * * *